US008967287B2

(12) United States Patent
Rivera et al.

(10) Patent No.: US 8,967,287 B2
(45) Date of Patent: Mar. 3, 2015

(54) RIPPER TIP FOR A RIPPER SHANK ASSEMBLY

(71) Applicant: Caterpillar Inc., Peoria, IL (US)

(72) Inventors: Emily J. Rivera, Washington, IL (US); Clifford O. Jeske, Brimfield, IL (US); Murray A. Smith, Oro-Medonte (CA); Craig Harder, Edmonton (CA)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/629,161

(22) Filed: Sep. 27, 2012

(65) Prior Publication Data

US 2013/0081833 A1 Apr. 4, 2013

Related U.S. Application Data

(60) Provisional application No. 61/542,042, filed on Sep. 30, 2011.

(51) Int. Cl.
*A01B 13/08* (2006.01)
*E02F 9/28* (2006.01)

(52) U.S. Cl.
CPC ..... *E02F 9/2875* (2013.01)
USPC ..... 172/699; 172/772

(58) Field of Classification Search
USPC ..... 172/699, 719, 772, 772.5, 196, 700; 37/404
See application file for complete search history.

(56) References Cited

U.S. PATENT DOCUMENTS

| | | | | |
|---|---|---|---|---|
| 3,001,591 | A | 9/1961 | Johnson | |
| 3,085,635 | A * | 4/1963 | Livermore | 172/699 |
| 3,171,500 | A | 3/1965 | Dills, Jr. | |
| 3,254,727 | A * | 6/1966 | Helton et al. | 172/719 |
| 3,268,012 | A | 8/1966 | Ratkowski | |
| 3,387,668 | A | 6/1968 | Mathers | |
| 3,536,147 | A * | 10/1970 | Olson et al. | 172/719 |
| 3,538,986 | A | 11/1970 | Stoffel | |
| 3,704,753 | A | 12/1972 | Hasforth et al. | |
| 3,851,413 | A | 12/1974 | Lukavich | |
| 3,959,901 | A * | 6/1976 | Klett | 37/452 |
| 3,961,788 | A | 6/1976 | Helton et al. | |
| 3,999,614 | A | 12/1976 | Rhoads | |
| 4,013,130 | A | 3/1977 | Wirt et al. | |
| 4,127,073 | A | 11/1978 | Blair | |

(Continued)

FOREIGN PATENT DOCUMENTS

| | | |
|---|---|---|
| AU | 40299/85 | 10/1985 |
| GB | 1219170 | 1/1971 |

(Continued)

OTHER PUBLICATIONS

U.S. Appl. No. 13/629,165, filed on Sep. 27, 2012.

(Continued)

*Primary Examiner* — Matthew D Troutman
(74) *Attorney, Agent, or Firm* — Finnegan, Henderson, Farabow, Garrett & Dunner, LLP

(57) ABSTRACT

A ripper tip includes a front end, a rear end, and a mounting cavity extending into the rear end. The ripper tip further includes an upper surface extending between the front end and the rear end, wherein a portion of the upper surface at the rear end of the ripper tip includes an upwardly projecting ridge having ridge sides and a ridge top that extend rearwardly on the ripper tip.

10 Claims, 14 Drawing Sheets

(56) References Cited

U.S. PATENT DOCUMENTS

| | | | | | |
|---|---|---|---|---|---|
| 4,129,934 | A | | 12/1978 | Gettman | |
| 4,415,042 | A | * | 11/1983 | Cosson | 172/749 |
| 4,601,248 | A | * | 7/1986 | Beasley | 111/140 |
| 4,716,668 | A | | 1/1988 | Hahn | |
| 4,762,184 | A | * | 8/1988 | Yeomans | 172/704 |
| 4,932,478 | A | * | 6/1990 | Jones | 172/699 |
| D329,243 | S | * | 9/1992 | Robinson | D15/29 |
| 5,333,696 | A | | 8/1994 | Cornelius | |
| 5,350,022 | A | * | 9/1994 | Launder et al. | 172/700 |
| 5,502,905 | A | * | 4/1996 | Cornelius et al. | 37/460 |
| D389,844 | S | * | 1/1998 | Moreno | D15/29 |
| D391,583 | S | * | 3/1998 | Moreno | D15/29 |
| D395,661 | S | * | 6/1998 | Moreno | D15/29 |
| D399,852 | S | | 10/1998 | Launder | |
| D408,422 | S | * | 4/1999 | Moreno | D15/29 |
| 5,964,300 | A | | 10/1999 | Wattonville et al. | |
| 6,401,834 | B1 | * | 6/2002 | Yeomans | 172/701.3 |
| 6,443,237 | B1 | * | 9/2002 | Myers et al. | 172/730 |
| 6,467,204 | B1 | | 10/2002 | Creighton | |
| 6,757,995 | B2 | * | 7/2004 | Pippins | 37/468 |
| 8,371,049 | B2 | * | 2/2013 | Tajiri et al. | 37/403 |
| 2004/0016153 | A1 | * | 1/2004 | Pippins | 37/456 |
| 2008/0060231 | A1 | * | 3/2008 | Tajiri et al. | 37/404 |
| 2008/0148608 | A1 | * | 6/2008 | Harder et al. | 37/455 |

FOREIGN PATENT DOCUMENTS

| | | |
|---|---|---|
| SU | 1101524 | 7/1984 |
| WO | 9603023 | 2/1996 |
| WO | 2004007852 | 1/2004 |

OTHER PUBLICATIONS

U.S. Appl. No. 13/629,210, filed on Sep. 27, 2012.

* cited by examiner

RIPPER TIP FOR A RIPPER SHANK ASSEMBLY

RELATED APPLICATIONS

This application is based on and claims the benefit of priority from U.S. Provisional Application No. 61/542,042, filed Sep. 30, 2011, the contents of which are expressly incorporated herein by reference.

TECHNICAL FIELD

The present disclosure relates to ground engaging tools, and more particularly to a ripper tip for a ripper shank assembly.

BACKGROUND

In the operation of ground-engaging machinery, especially of the type known as track type tractors, it is a common practice to position an apparatus on the machine that will penetrate tough material and loosen it to aid its removal. This apparatus is commonly referred to as a ripper shank assembly. Typical ripper shank assemblies include one or more main beam members, referred to as ripper shanks, that are mounted within a framework that is raised and lowered under power to engage and penetrate the terrain. The ripper is then moved through the terrain as the machine is powered in a forward direction.

Such ripper assemblies normally employ replaceable tips and shank protectors at the end of the ripper shank that is lowered into the earth formation. The ripper tip and shank protectors that contact the earth are subjected to vigorous abrasion during the ripping operation. For this reason replaceable ripper tips and shank protectors are provided so that the entire shank does not have to be replaced as often.

One such ripper shank assembly is disclosed in U.S. Pat. No. 3,999,614 to Rhoads ("the '614 patent"). The ripper shank assembly of the '614 patent includes a ripper tip provided with a socket for receiving a lower end of a ripper shank. A shank guard/protector includes a latching arrangement including a hook adapted to engage a recess or slot formed in a raised portion of the upper surface of the ripper tip. The shank guard/protector is further adapted to pivot around a shoulder adjacent the recess until it is fully received on the ripper shank. The shank guard/protector is then held in a locked position by a pin or screw.

SUMMARY

One disclosed embodiment relates to a ripper tip that includes a front end, a rear end, and a mounting cavity extending into the rear end. The ripper tip further includes an upper surface extending between the front end and the rear end, wherein a portion of the upper surface at the rear end of the ripper tip includes an upwardly projecting ridge having ridge sides and a ridge top that extend rearwardly on the ripper tip.

This disclosure further relates to a ripper tip including a front end, a rear end, and a mounting cavity extending into the rear end. In addition, the ripper tip includes an upper surface, the upper surface including a first ridge and a second ridge disposed between the first ridge and the front end of the ripper tip, the second ridge being flanked by a pair of depressions in the upper surface.

Even further, this disclosure relates to a ripper tip including a front end, a rear end, and a mounting cavity extending into the rear end. The ripper tip further includes an upper surface, the upper surface including a first ridge, the first ridge having ridge sides and a ridge top that extend rearward to a rear end surface of the ripper tip, wherein the ridge top slopes upward as it extends rearward and the ridge sides slope away from one another as they extend away from the ridge top. An end surface of the rear end of the ripper tip has a maximum thickness between the mounting cavity and the ridge top.

DETAILED DESCRIPTION

FIGS. 1-14C illustrate one embodiment of a ripper shank assembly 10 and components thereof according to the present disclosure. Ripper shank assembly 10 may be used on various types of machines. For example, ripper shank assembly 10 may be mounted to the rear of a tractor, a grader, or any other type of mobile machine. Ripper shank assembly 10 may have a base end 12 that attaches to a mobile machine. From base end 12, ripper shank assembly may extend downward and forward to a front end 14 of the ripper shank assembly 10. When mounted to such mobile machines, ripper shank assembly 10 may be used to till soil by lowering its front end 14 into the soil and driving it forward through the soil.

Figure 1:
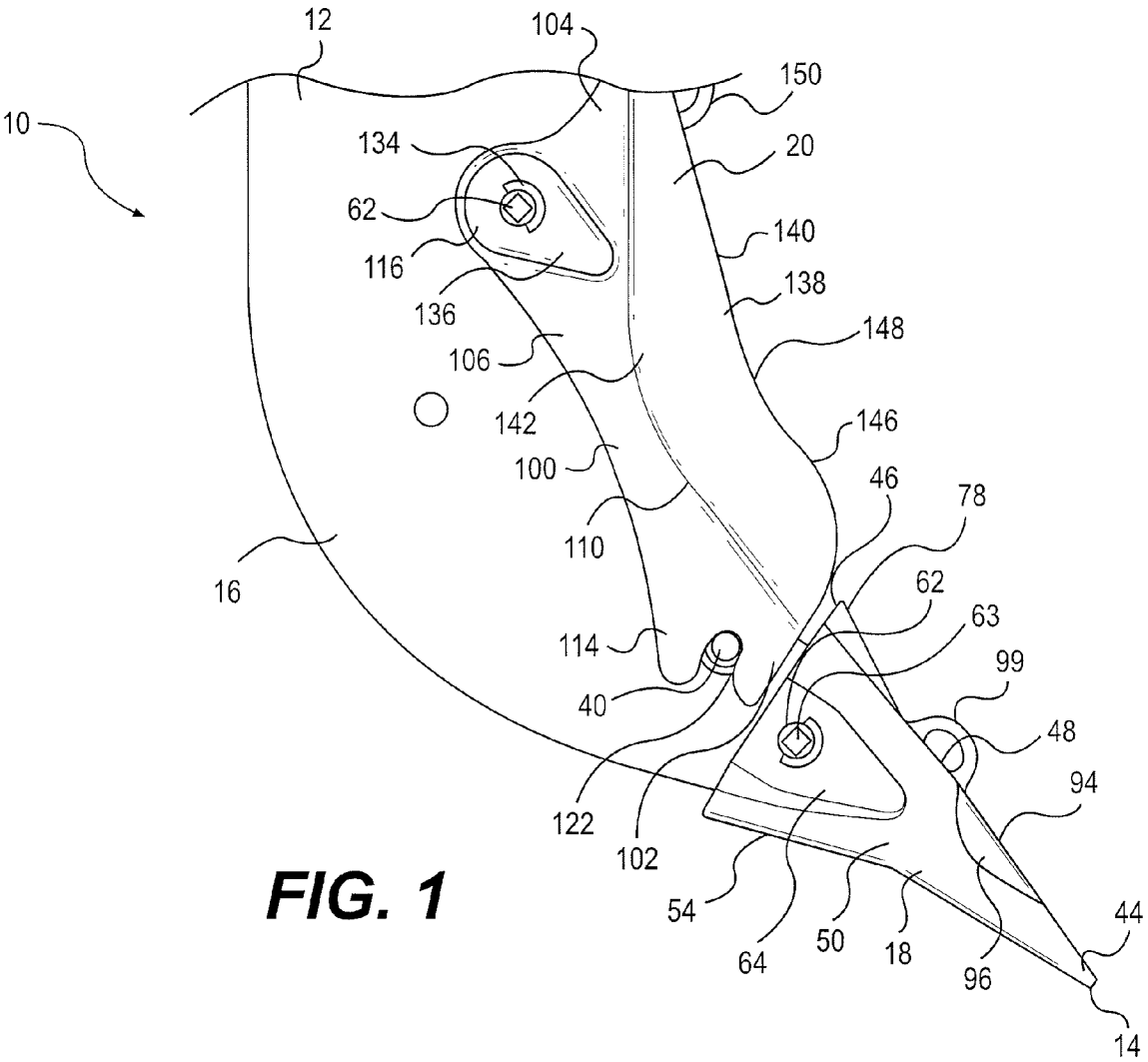
FIG. 1 is a side view of a ripper shank assembly according to the present disclosure.

As best shown in FIG. 1, ripper shank assembly 10 may include a ripper shank 16, a ripper tip 18, and a ripper shank protector 20. Ripper shank 16 may serve as the primary structural member or "backbone" of ripper shank assembly 10. Ripper tip 18 and ripper shank protector 20 may serve to shield portions of the front of ripper shank 16 from direct contact with soil.

Figure 12:
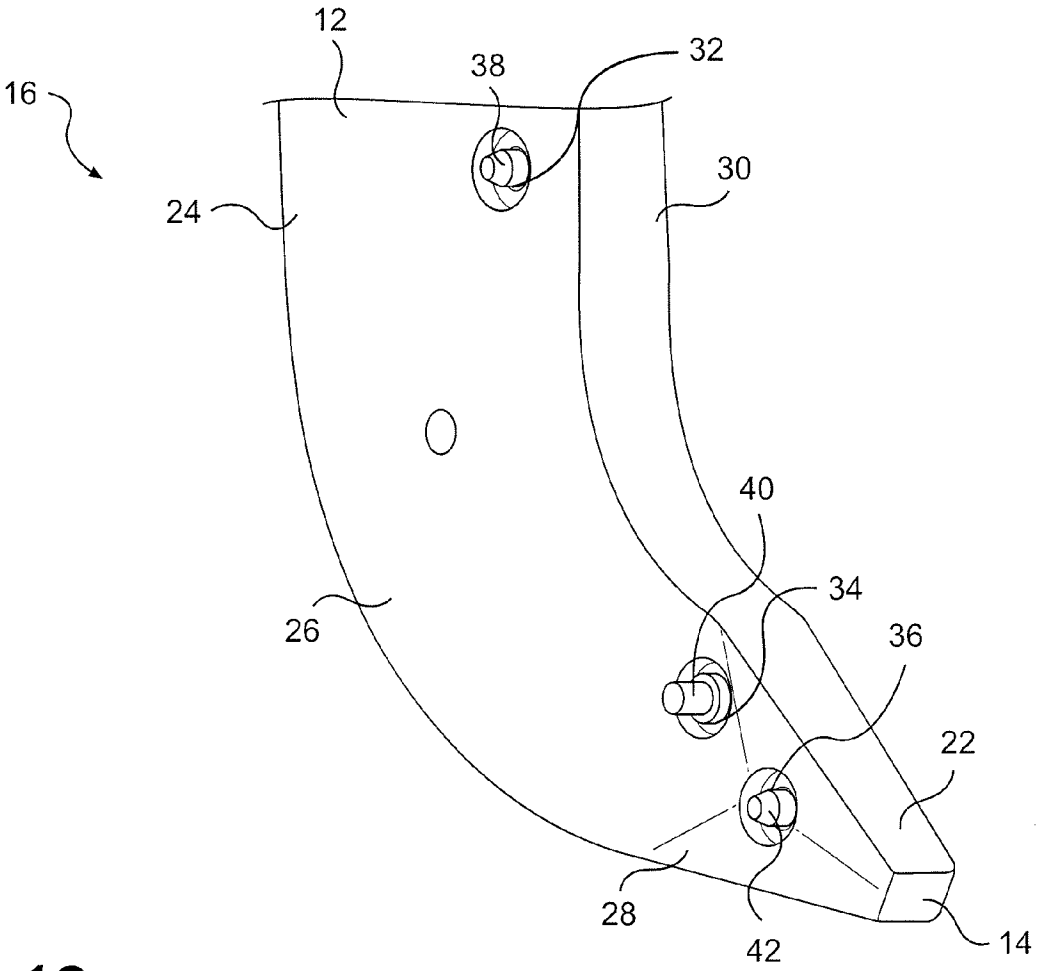
FIG. 12 is a perspective view of a ripper shank of the ripper shank assembly of FIG. 1.

FIG. 12 shows ripper shank 16 separate from ripper tip 18 and ripper shank protector 20. Like ripper shank assembly 10 generally, ripper shank 16 may extend from base end 12 downward and forward to a front end 22. Ripper shank 16 may include a straight upper portion 24 extending downward, a middle portion 26 that curves toward a straight portion, and a front portion 28 that extends primarily straight and forward. Front portion 28 may decrease in height as it extends to front end 22. A front edge 30 of ripper shank 16 may extend along upper portion 24, middle portion 26, and front portion 28 to front end 22. Ripper shank 16 may be constructed of various materials, including, but not limited to steel and cast iron.

Ripper shank 16 may have various features that facilitate securing ripper tip 18 and ripper shank protector 20 to ripper shank 16. For example, in the configuration shown in the drawings, ripper shank 16 includes bores 32, 34, 36 for receiving mounting projections 38, 40, 42 for attaching ripper tip 18 and ripper shank protector 20. Bores 32, 34, and 36 may be included in upper portion 24, middle portion 26, and front portion 28, respectively, of ripper shank 16. Projections 38, 40, 42 may have various configurations. In some embodiments, projections 38, 40, 42 may be pins extending out both sides of ripper shank 16, and having substantially circular cross-sections (which may vary in diameter over the length of the pins).

Figure 2:
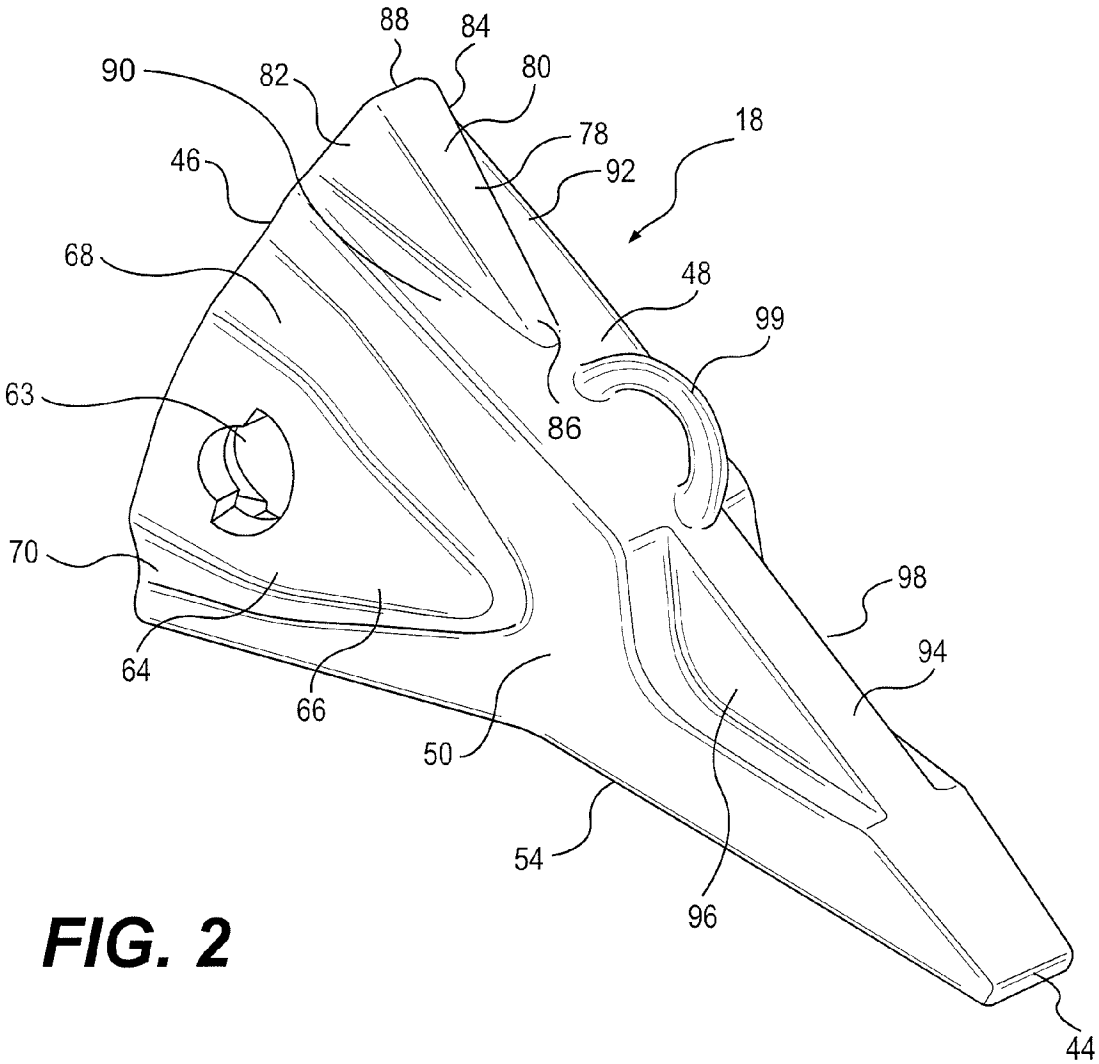
FIG. 2 is a front perspective view of a ripper tip of the ripper shank assembly of FIG. 1.
Figure 3:
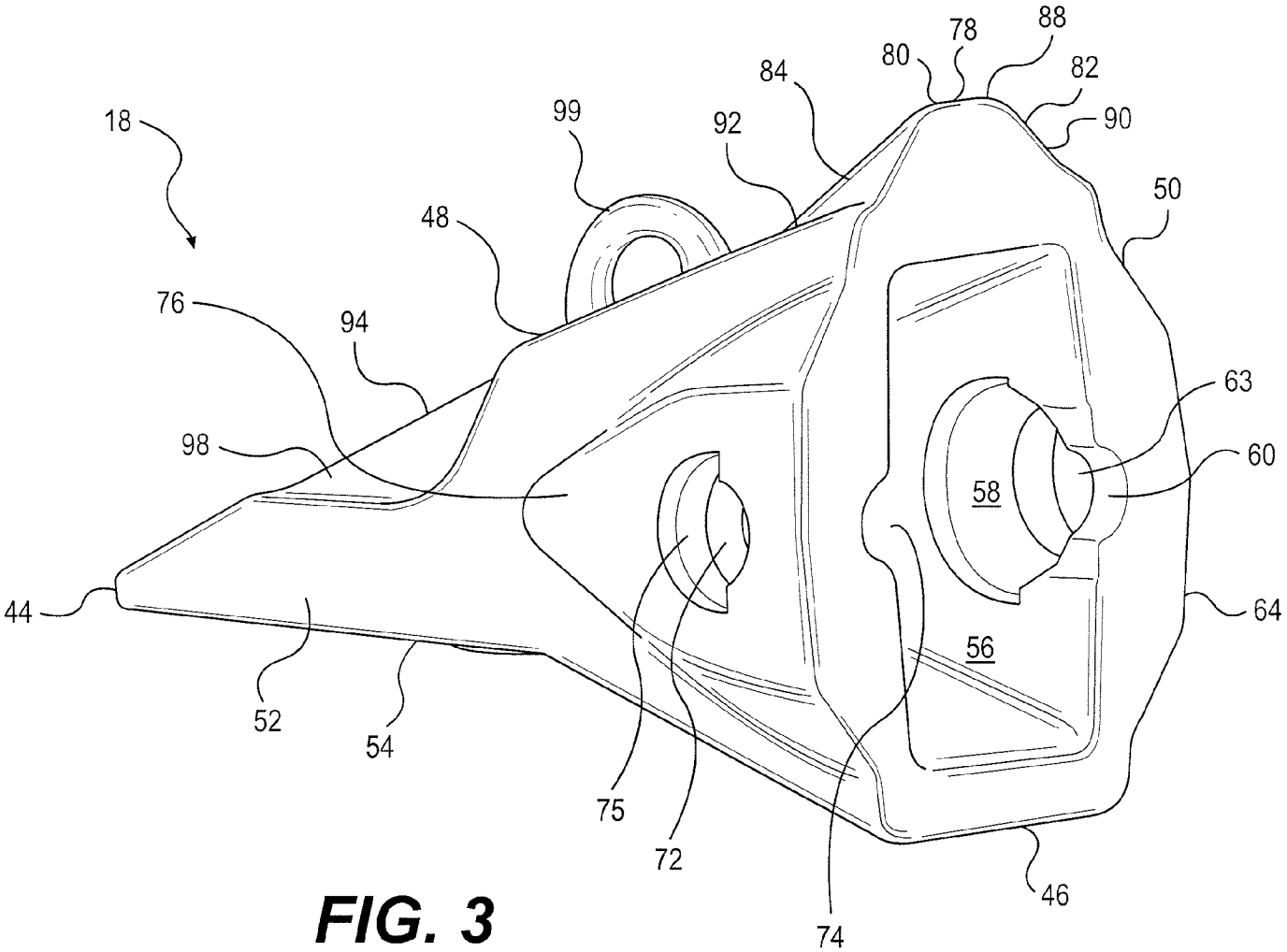
FIG. 3 is a rear perspective view of the ripper tip of FIG. 2.
Figure 4:
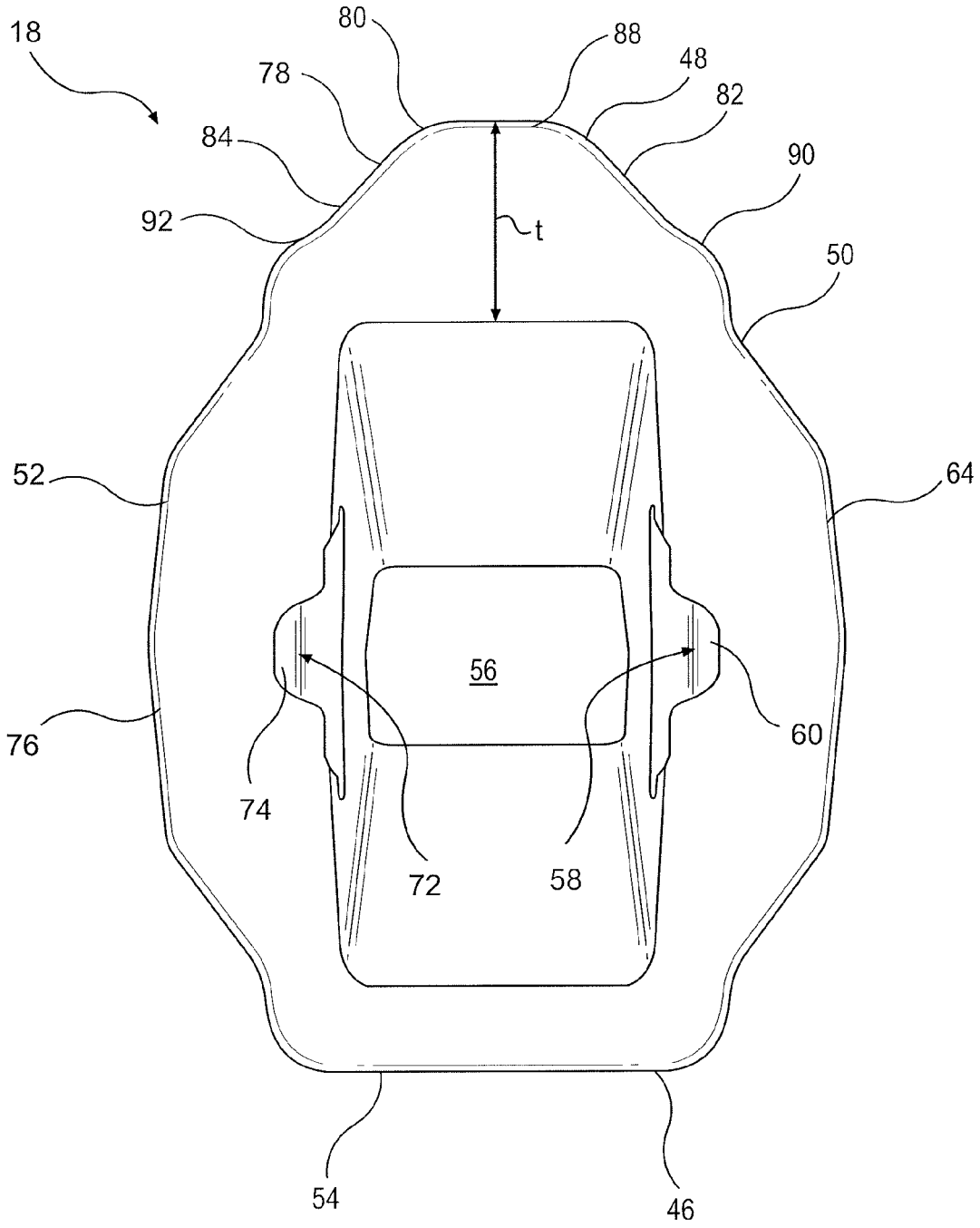
FIG. 4 is a rear end view of the ripper tip of FIG. 2.

Ripper tip 18 may mount to front end 22 of ripper shank 16. FIGS. 2-4 show ripper tip 18 separate from ripper shank 16 and ripper shank protector 20. Ripper tip 18 may include a front end 44 and a rear end 46. Extending between front end 44 and rear end 46, ripper tip 18 may include an upper surface 48, side surfaces 50, 52, and a lower surface 54. The front end 44 of ripper tip 18 may form a point. Thus, as they extend from rear end 46 toward front end 44, upper surface 48, side surfaces 50, 52, and/or lower surface 54 may taper vertically and/or horizontally. Ripper tip 18 may be constructed of various materials, including, but not limited to steel and cast iron.

As best shown in FIGS. 3 and 4, ripper tip 18 may include a mounting cavity 56 extending inward from rear end 46. Mounting cavity 56 may have a shape configured to receive and mate with front portion 28 of ripper shank 16. Accordingly, ripper tip 18 may be mounted to ripper shank 16 by placing front portion 28 of ripper shank 16 in mounting cavity 56 of ripper tip 18 and fastening ripper tip 18 in place. FIG. 1 shows ripper tip 18 assembled over front portion 28 of ripper shank 16.

Ripper tip 18 and ripper shank assembly 10 may include various provisions for fastening ripper tip 18 to ripper shank 16. In some embodiments, ripper shank assembly 10 may include provisions for securing ripper tip 18 to projection 42 extending from bore 36 in front portion 28 of ripper shank 16. For example, as best shown in FIG. 3, ripper tip 18 may include a lock cavity 58 and a slot 60 disposed adjacent mounting cavity 56. Lock cavity 58 may be configured to receive a rotating lock assembly 62 (shown in detail in FIGS. 14A-14C) operable to selectively lock ripper tip 18 to projection 42. Slot 60 may provide a path by which projection 42 may slide into lock cavity 58 and lock 62 when ripper tip 18 is slid into place on front portion 28 of ripper shank 16. Lock cavity 58 may be positioned such that it substantially aligns with projection 42 when ripper tip 18 is properly positioned on front portion 28 of ripper shank 16. A lock opening 63 may extend from side surface 50 into lock cavity 58 to provide access to manipulate lock 62 between locked and unlocked positions.

To accommodate lock cavity 58, side surface 50 may include a bulge 64. As shown in FIG. 2, bulge 64 may itself include a side surface 66, an upper surface 68, and a lower surface 70. At least a portion of side surface 66 may slope inward as it extends forward. Upper surface 68 and lower surface 70 may slope toward one another as they extend forward, converging at the forward end of bulge 64. Additionally, upper surface 68 and lower surface 70 may slope away from one another as they extend laterally away from side surface 66.

Adjacent side surface 52, ripper tip 18 may have a lock cavity 72, a slot 74, a lock opening 75, and a bulge 76 substantially the same as lock cavity 58, slot 60, lock opening 63, and bulge 64. The discussion in this disclosure of lock cavity 58, slot 60, lock opening 63, and bulge 64 adjacent side surface 50 equally applies to the same elements adjacent side surface 52 of ripper tip 18.

In addition to bulges 64, 76, ripper tip 18 may include various other features on its exterior surfaces. For example, adjacent rear end 46, upper surface 48 may include an upwardly projecting ridge 78. Ridge 78 may extend longitudinally on upper surface 48. Ridge 78 may be substantially centered on ripper tip 18 in lateral directions. Ridge 78 may include a ridge top 80 and ridge sides 82, 84. From a front end 86 of ridge 78, ridge top and ridge sides 82, 84 may extend toward the rear end of ripper tip 18. The front end 86 and a rear end 88 of ridge 78 may be located at various points along ripper tip 18. As shown in the drawings, in some embodiments, front end 86 of ridge 78 may be disposed in a rear half of ripper tip 18, and rear end 88 of ridge 78 may coincide with a rear end surface of rear end 46 of ripper tip 18.

Ridge 78 may have a wedge shape, both from the side and from above. As it extends rearward, ridge 78 may slope upward. As shown in FIG. 4, the rear end surface of ripper tip 18 has a maximum thickness (t) between mounting cavity 56 and ridge top 80 (i.e., a greater thickness than the thickness from mounting cavity 56 to side or lower surfaces 50, 52, 54 at the rear end surface of the ripper tip 18). Ridge sides 82, 84 may slope away from one another as they extend away from ridge top 80. Additionally, ridge sides 82, 84 may slope away from one another as they extend rearward. Ridge top 80 and ridge sides 82, 84 may have various shapes. As shown in the figures, in some embodiments, ridge top 80 and ridge sides 82, 84 may have substantially planar shapes. Alternatively, ridge top 80 and/or ridge sides 82, 84 may include one or more concave and/or convex portions.

Adjacent the base of ridge sides 82, 84, upper surface 48 of ripper tip 18 may include shoulders 90, 92. Shoulders 90, 92 may have various shapes. In some embodiments, shoulders 90, 92 may be substantially planar. Alternatively, shoulders 90, 92 may have one or more convex and/or concave portions. Shoulders 90, 92 may extend over the full length of ridge 78 to the rear end 46 of ripper tip 18. Alternatively, shoulders 90, 92 may extend over only part of the length of ridge 78.

Ripper tip 18 may also include a ridge 94 disposed between ridge 78 and front end 44 of ripper tip 44. Like ridge 78, ridge 94 may extend longitudinally, and may be substantially laterally centered on ripper tip 18. Rather than projecting upward from upper surface 48, ridge 94 may be flanked by depressions 96, 98 in upper surface 48. In some embodiments, the top of ridge 94 may be substantially flush with portions of upper surface 48 in forward and rearward of ridge 94. Indeed, in some embodiments, the top of ridge 94 may be substantially coplanar with shoulders 90, 92 flanking ridge 78.

Ripper tip 18 may also have an eye 99 mounted to upper surface 48. Eye 99 may allow attaching a lifting apparatus to ripper tip 18 to facilitate maneuvering ripper tip 18. Eye 99 may be attached between ridge 78 and ridge 94.

As shown in FIG. 1, ripper shank protector 20 may be configured to mount to ripper shank 16 behind and above ripper tip 18. FIGS. 6-11 show ripper shank protector 20 from various angles. Ripper shank protector 20 may have a body 100 with a front end 102 and a rear end 104. Body 100 may include sides 106, 108 and a center face 110 extending between sides 106, 108. As best shown in FIGS. 7, 8, 10, and 11, a mounting cavity 112 may be disposed between sides 106, 108 adjacent an underside of center face 110. Mounting cavity 112 may be configured to receive and mate with front edge 30 of ripper shank 16. Ripper shank protector 20 may be constructed of various materials, including, but not limited to steel and cast iron.

Ripper shank protector 20 may include various provisions for securing it to ripper shank 16. In some embodiments, ripper shank protector may include mounts 114 and 116 in side 106, and mounts 118 and 120 in side 108. Mount 114 may include an open-ended slot 122 configured to receive one end of projection 40 extending from bore 34 in ripper shank 16. Slot 122 may extend generally away from center face 110 of ripper shank protector 20. Edges of slot 122 may taper away from one another as they extend outward. An inner end of slot 122 may have a substantially round shape. For example, the inner end of slot 122 may have a constant radius of curvature substantially the same as the radius of curvature of the portion of projection 40 that slot 122 engages. Mount 118 may have a slot 124 configured to engage an end of projection 40 opposite the one that slot 122 engages. Slot 124 may be aligned with and have substantially the same shape as slot 122.

Figure 13:
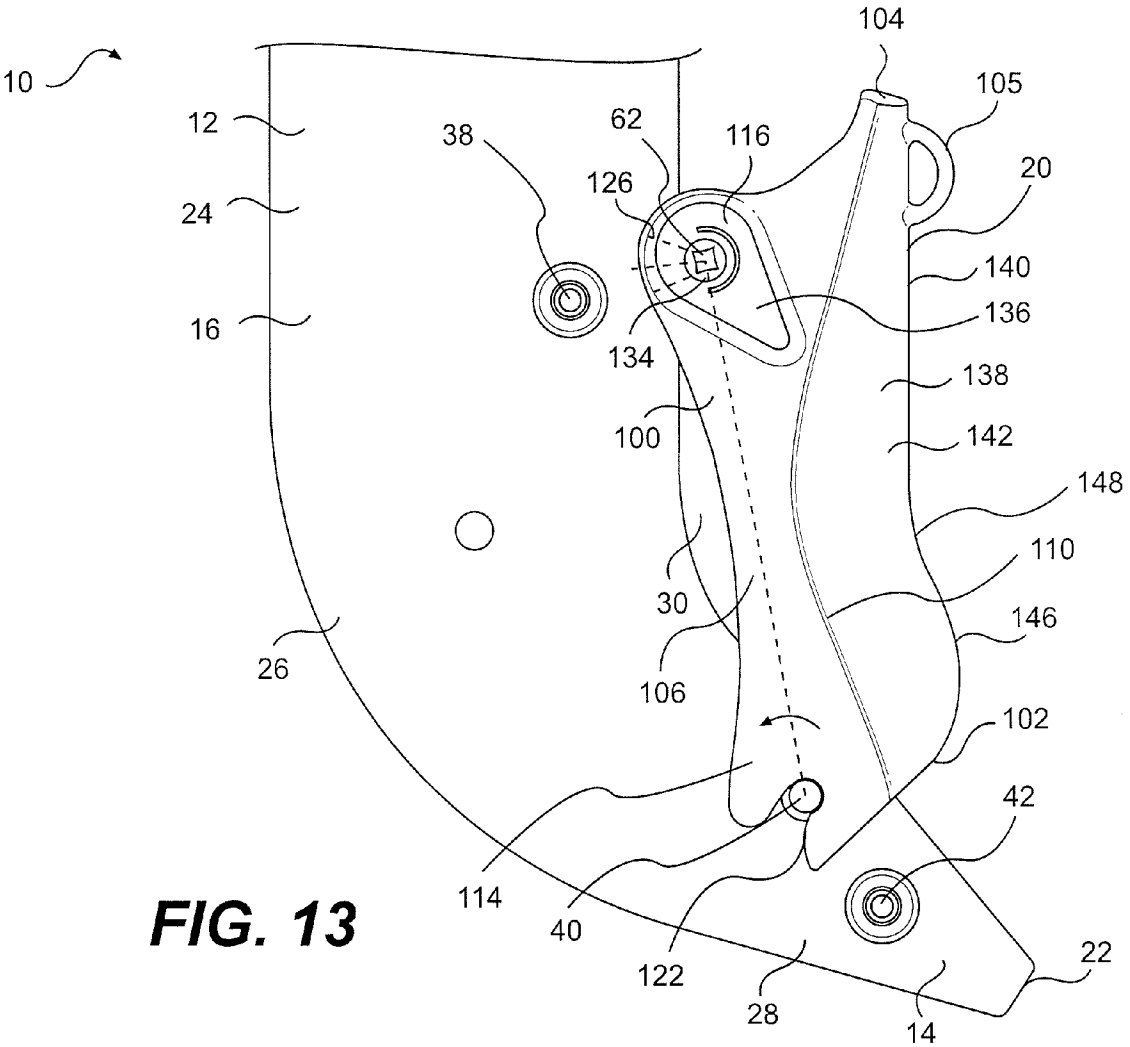
FIG. 13 is a side view of the ripper shank and shank protector during mounting.

As best understood by referring to FIG. 13, slots 122, 124 allows for the sliding of mounts 114, 118 into engagement with projection 40 extending from each side of ripper shank 16. To do so, ripper shank protector 20 may be lifted above ripper shank 16 and maneuvered to a position where slots 122 are disposed generally above the opposite ends of projection 40. Then, ripper shank protector 20 may be lowered while guiding the open ends of slots 122, 124 over the ends of projection 40. The outwardly tapering surfaces of the outer ends of slots 122, 124 may help guide the slots 122, 124 into alignment with the projection 40. Once the slots 122, 124 are aligned with the projection 40, ripper shank protector 20 may be lowered until projection 40 seats in the inner ends of slots 122, 124. In this state, the substantially round surface at the inner end of each slot 122, 124 may rest on the correspond round surface of the projection 40. This allows for a pivoting of ripper shank protector 20 about projection 40 into proper engagement with front edge 30 of ripper shank 16. Such pivoting is depicted by the arrow in FIG. 13.

Figure 8:
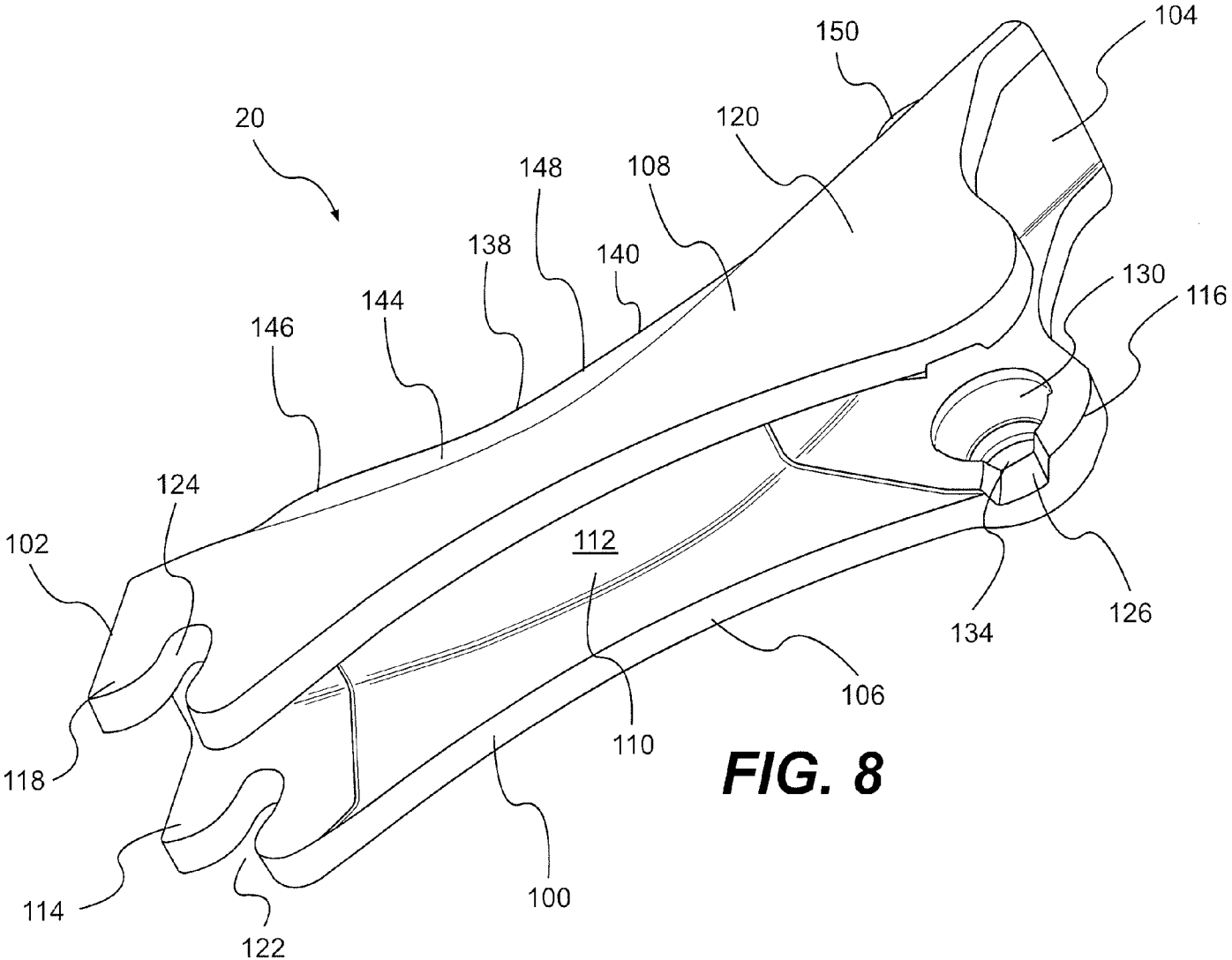
Figure 9:
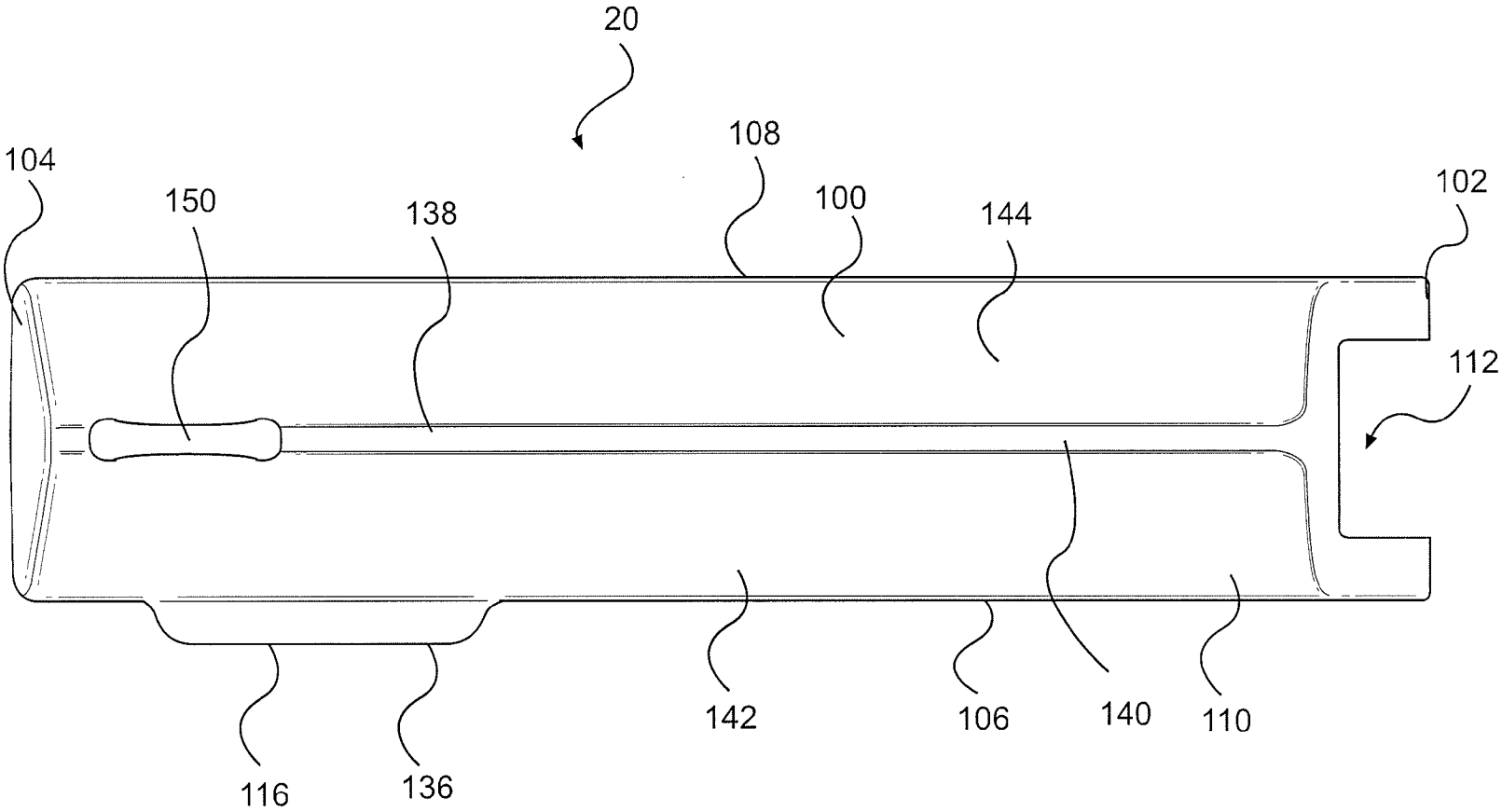
FIG. 9 is a top view of the shank protector of FIG. 6.

Mounts 116 and 120 may include features that engage projection 38 as ripper shank protector 20 is pivoted in this manner on projection 40. For example, as best shown in FIG. 8, mount 116 may include a slot 126 on an inside surface of side 106. Slot 126 may be spaced from mount 114 by substantially the same distance that projection 38 is spaced from projection 40. Accordingly, as ripper shank protector 20 is pivoted into place about projection 40, slot 126 substantially aligns with projection 38. Thus, as indicated in the dashed lines of FIG. 13, slot 126 extends substantially perpendicular to a line extending between the projection receiving portions of mount 116 and mount 114. Accordingly, slot 126 slides over projection 40 while ripper shank protector 20 is pivoted into place.

Figure 7:
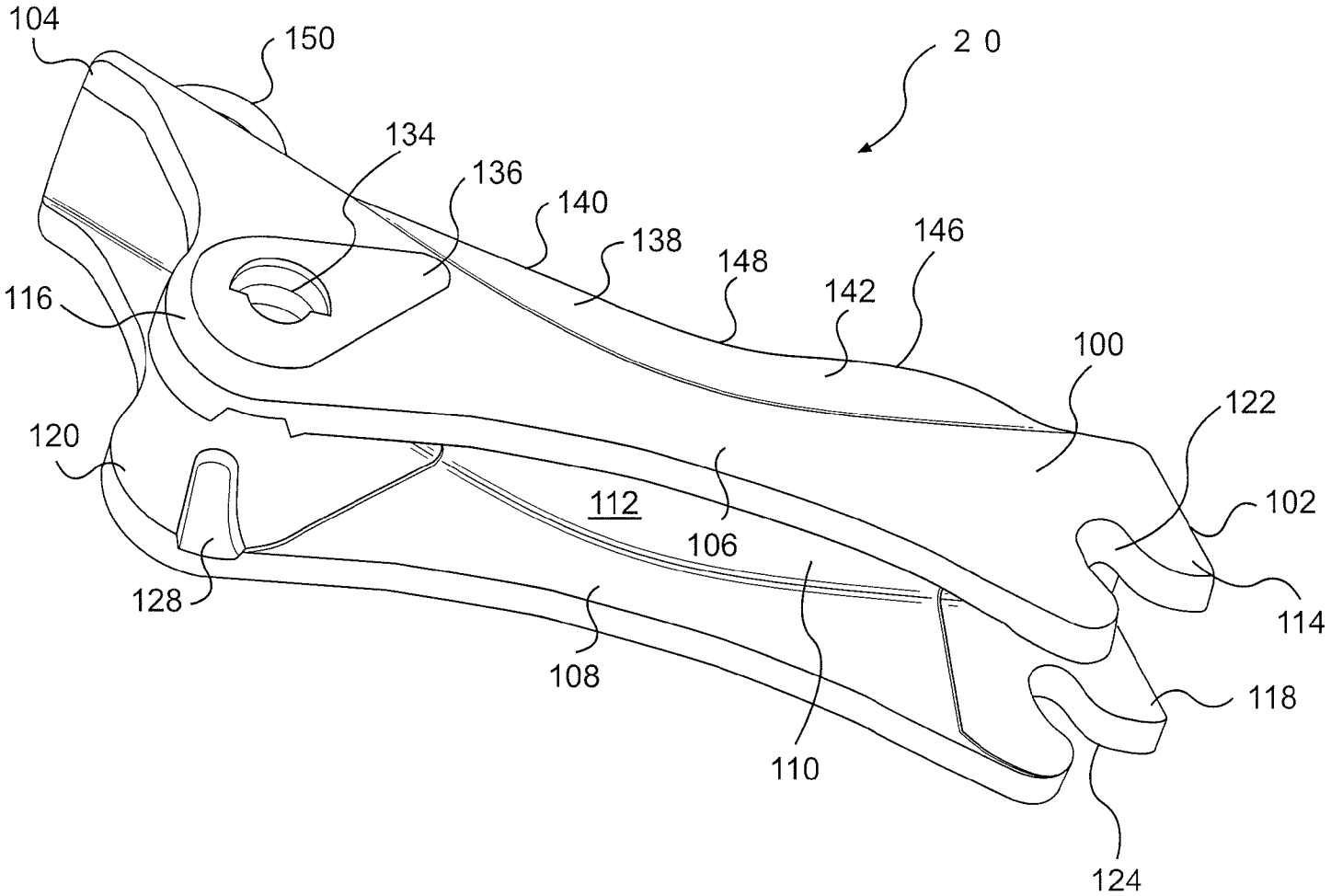
FIGS. 7 and 8 are bottom perspective views of the shank protector of FIG. 6.

As best shown in FIG. 7, mount 120 of shank protector 20 may include a slot 128 for receiving an end of projection 38 opposite the end received by slot 126. Similar to slot 126, slot 128 may be spaced from mount 118 by substantially the same distance that projection 38 is spaced from projection 40. Thus, slot 128 extends in the same direction as slot 126, i.e., substantially perpendicular to a line extending between projection receiving portions of mount 120 and mount 118. Accordingly, when ripper shank protector 20 is pivoted about projection 40, slot 128 slides into place over projection 38. An inner end of slot 128 may include a round surface that rests on projection 38.

Returning to FIG. 8, mount 116 may include a lock cavity 130 at the inner end of slot 126. Lock cavity 130 may be configured to receive a rotating lock assembly 62 (shown in detail in FIGS. 14A-14C) configured to selectively lock to projection 38. A lock opening 134 may extend through side 106 of ripper shank protector 20 to allow to lock assembly 62 to lock and unlock it. Lock cavity 130 and lock assembly may have substantially the same configuration as lock cavity 58 and lock assembly 62 of ripper tip 18, such that lock assembly 62 may be used interchangeably between shank protector 120 and ripper tip 18.

To accommodate lock cavity 130 and lock assembly 62, the outer surface of side 106 may include a bulge 136. Bulge 136 may be elongated. The direction in which bulge 136 is elongated may differ from the direction that slot 126 extends. This is best observed by referring to FIG. 7 and remembering that slot 126 extends in the same direction as slot 128. Thus, comparing the direction that bulge 136 is elongated to the direction slot 128 extends, shows that bulge 136 is elongated in a significantly different direction than the direction that slot 126 extends. Whereas slot 126 extends generally toward center face 110 of ripper shank protector 20, bulge 136 is elongated in a direction generally toward front end 102 of ripper shank protector 20. Additionally, bulge 136 may taper inward as it extends toward front end 102 of ripper shank protector 20.

Figure 10:
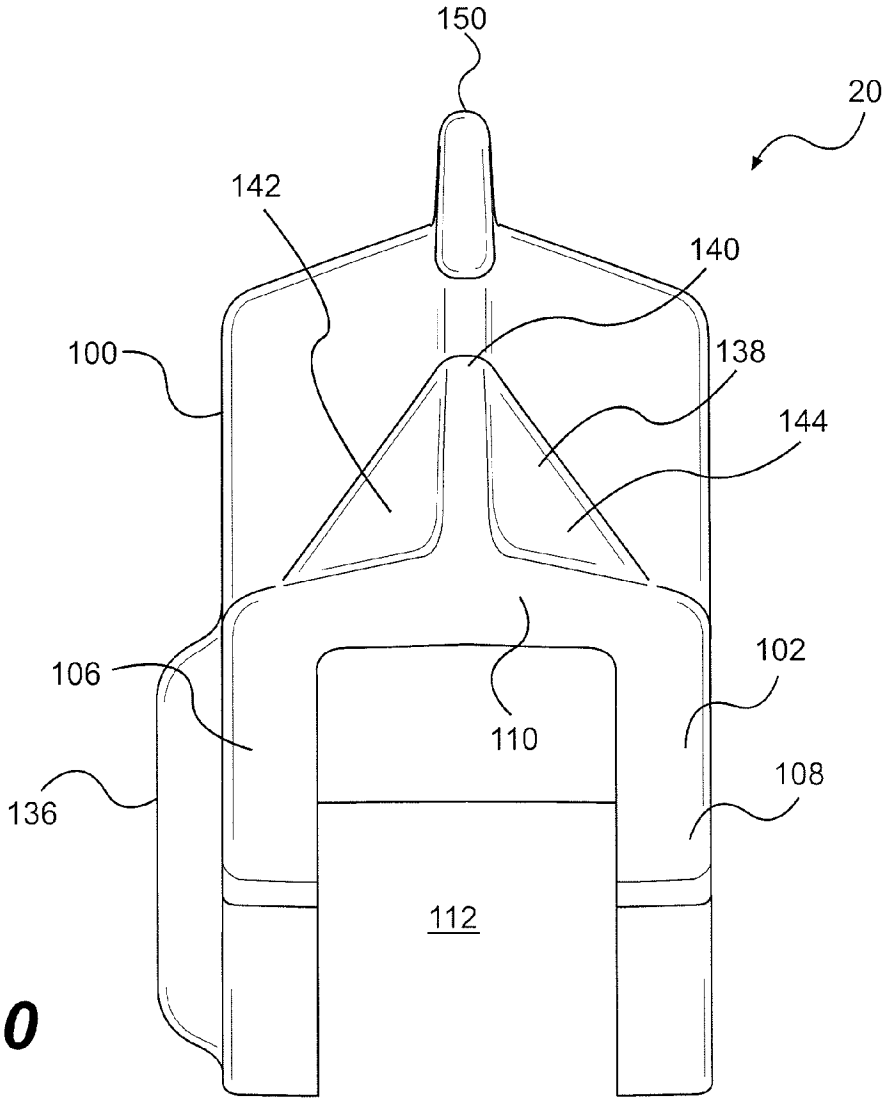
FIG. 10 is a front end view of the shank protector of FIG. 6.
Figure 11:
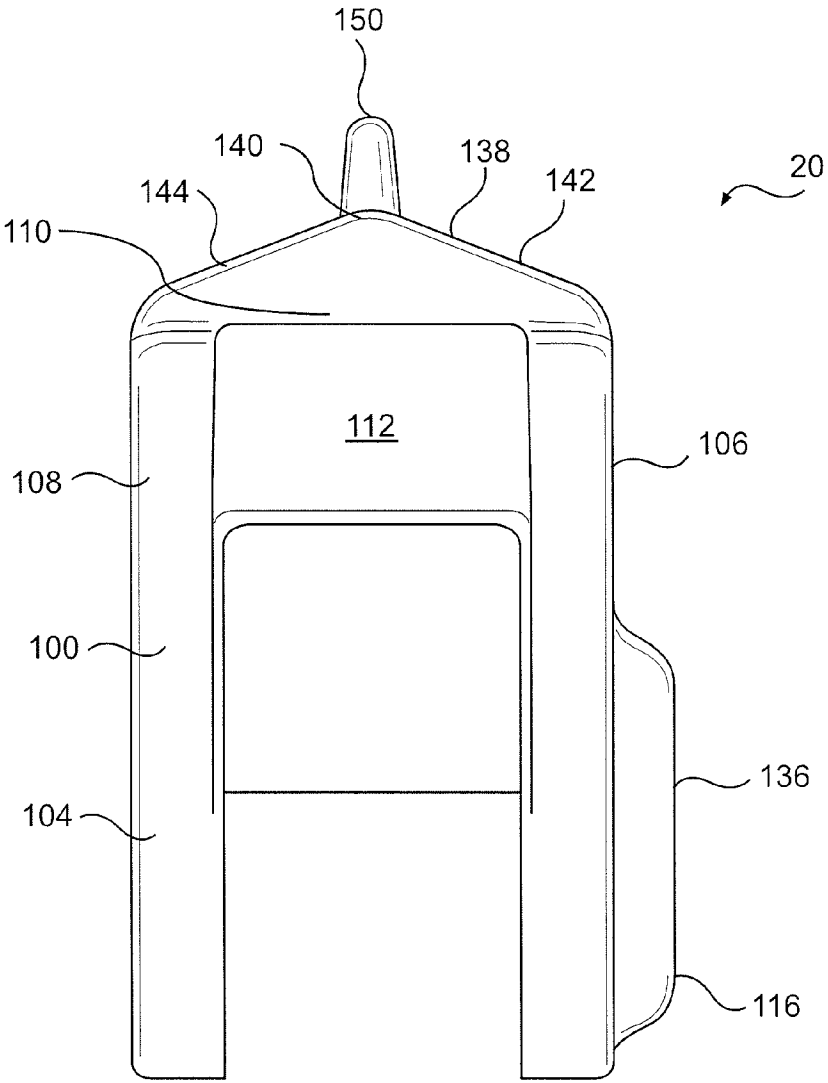
FIG. 11 is a back end view of the shank protector of FIG. 6.

As best shown in FIGS. 1, 5, 6, 9, and 10, ripper shank protector 20 may include a ridge 138 projecting upward from center face 110. Ridge 138 may extend longitudinally along center face 110. In some embodiments, ridge 138 may extend over the entire length of center face 110. Alternatively, ridge 138 may extend over only a portion of the length of center face 110. As best shown in FIGS. 1, 5, 9, and 10, ridge 138 may have a top 140 and sides 142, 144. Ridge 138 may have various lateral cross-sectional shapes. As best shown in FIG. 10, in some embodiments, sides 142, 144 of ridge 138 may slope away from one another as they extend away from top 140.

Figure 5:
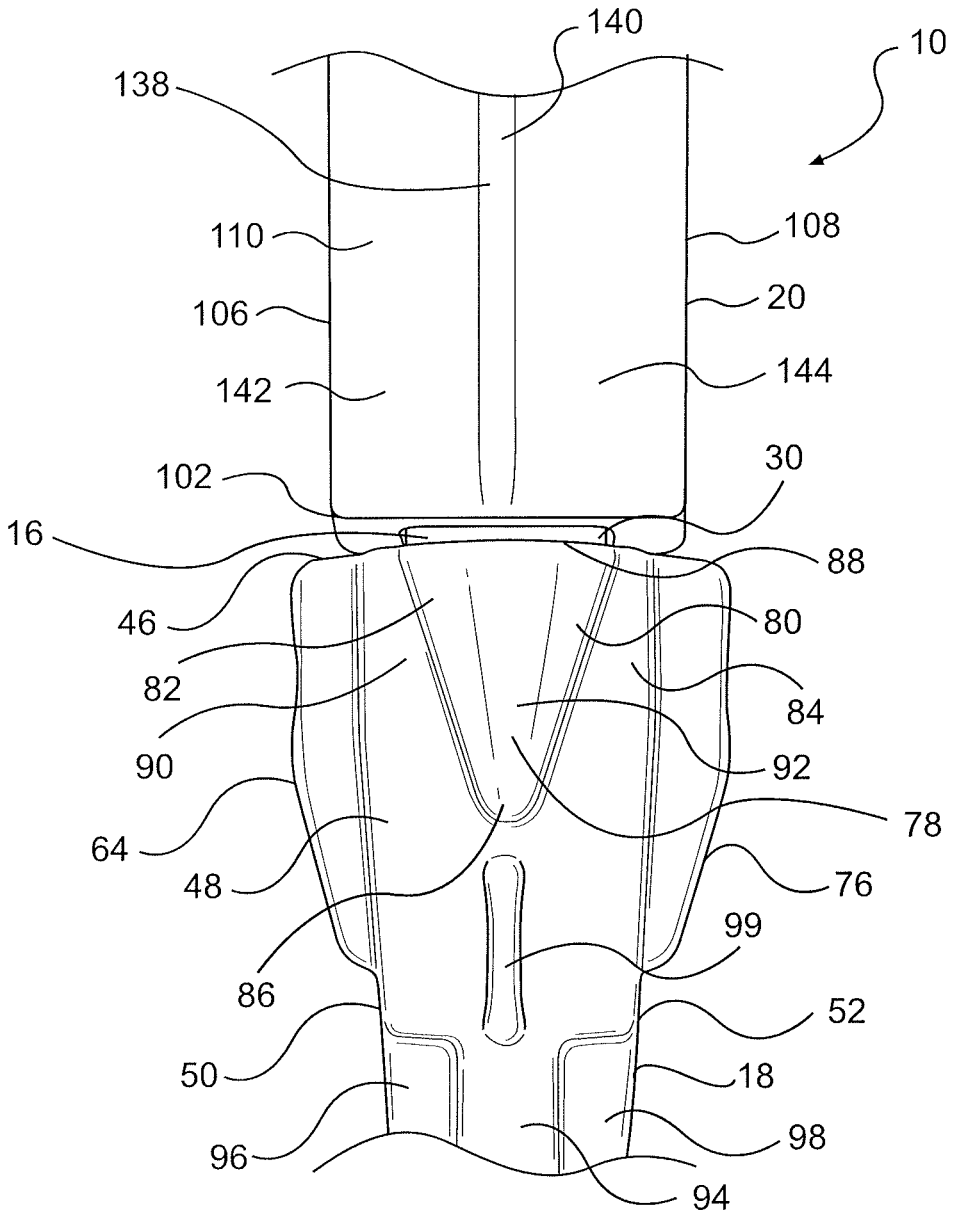
FIG. 5 is a partial top view of the ripper shank assembly of FIG. 1.

Ridge 138 may be positioned in various manners laterally. In some embodiments, ridge 138 may be laterally aligned with ridge 78 of ripper tip 18. For example, as best shown in FIG. 5, in some embodiments ridges 78 and 138 may both be laterally centered.

Figure 6:
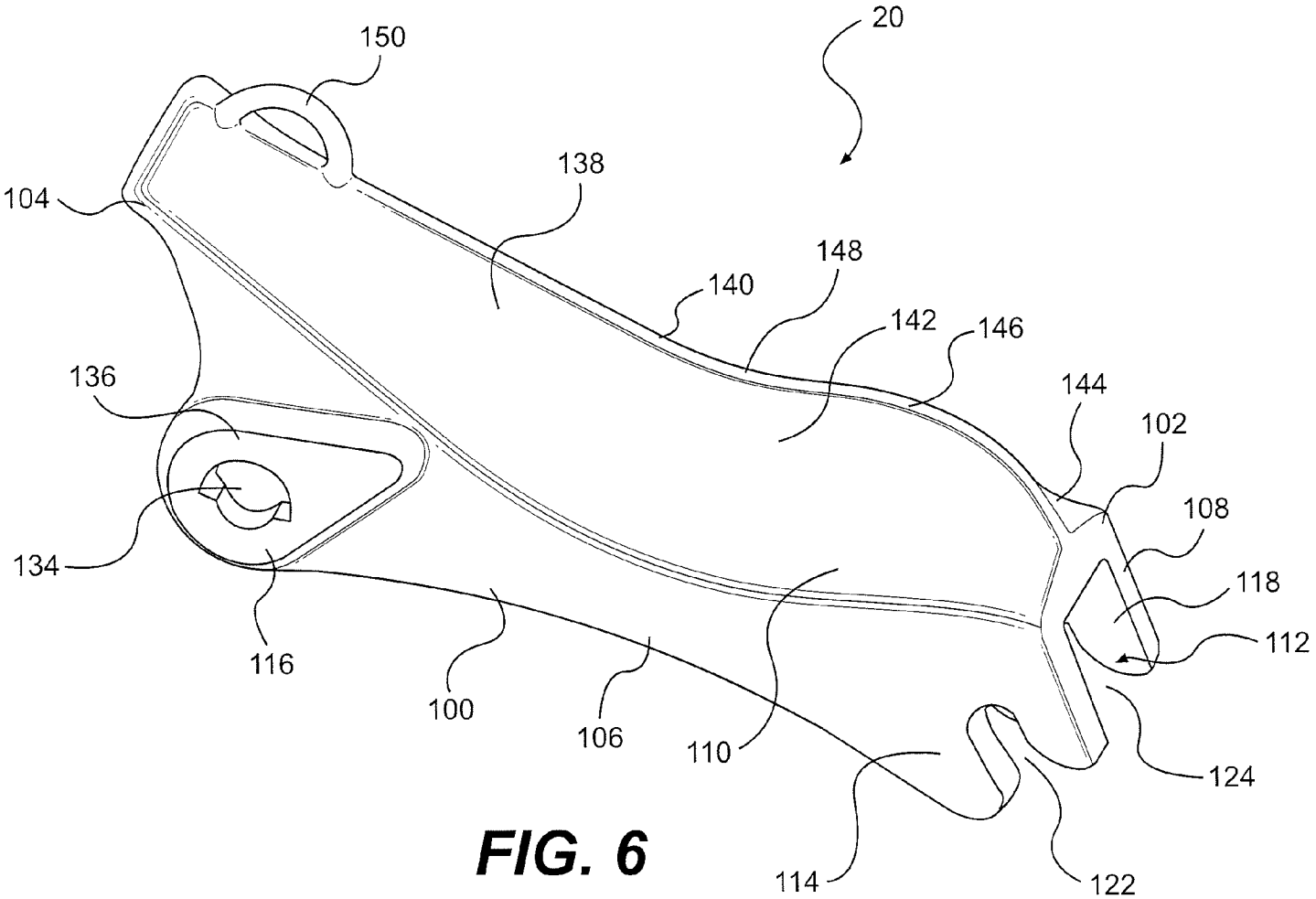
FIG. 6 is a top perspective view of a ripper shank protector of the assembly of FIG. 1.

Ridge 138 may have various longitudinal profiles. As best shown in FIGS. 1, 6, and 13, the height or thickness of ridge 138 (from the surface of center face 110 mating with ripper shank 16) may vary over the length of ridge 138. In some embodiments, the front portion of ridge 138 may slope upward to a maximum height at the front end 102 of ripper shank protector 20. The height of ridge 138 may gradually decrease in height as it extends to the rear end 104 of shank protector 120. As best shown in FIG. 1, the front portion of ridge 138 may rise to a height greater than the height of ridge 78 on ripper tip 18. The front portion of ridge 138 may also include a section that has a convex profile 146 that curves as it extends away from the front end 102 of ripper shank protector 20. Farther back, ridge 138 may include a section with a concave profile that merges with a generally straight section as the profile extends away from the front end 102 of ripper shank protector 20.

Similar to ripper tip 18, ripper shank protector 20 may include an eye 150. Eye 150 may be attached to ridge 138. Eye 150 may facilitate suspending ripper shank protector 20 from a hoist to maneuver it.

Figures 14A, 14B, 14C:
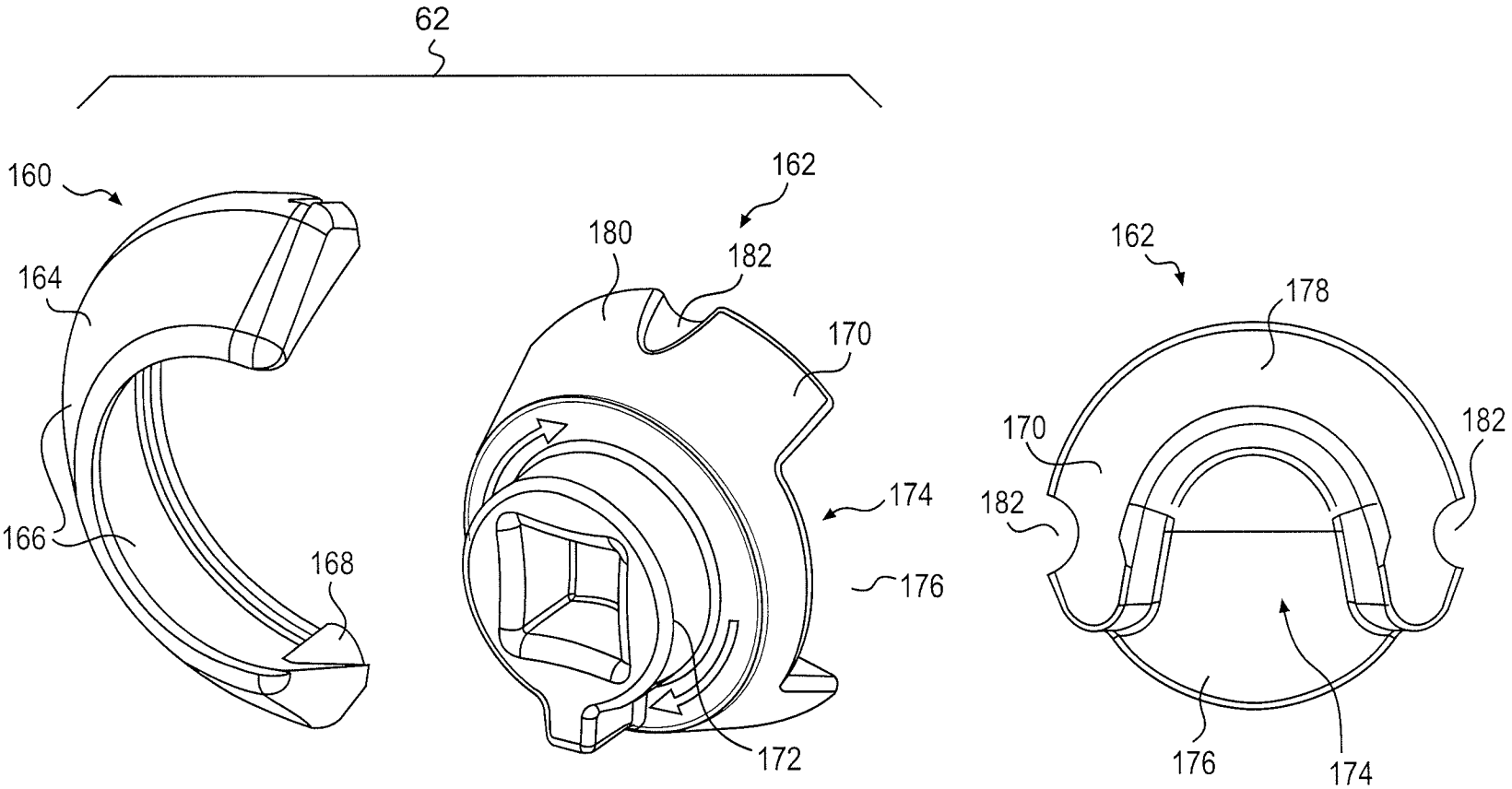
FIG. 14A is a perspective view of a sleeve of a rotating lock assembly of the ripper shank assembly of FIG. 1.
FIG. 14B is a perspective view of a lock of the rotating lock assembly.
FIG. 14C is a rear view of the lock of FIG. 14B.

Referring to FIGS. 14A-14C, rotating lock assembly 62 may include a sleeve 160 and a lock 162 for each of lock cavities 58, 72, 130 of the ripper tip 18 and shank protector 20, respectively. Each sleeve 160 includes a C-shaped skirt 164 with a smooth frustoconical inner and outer surface 166. Each sleeve 160 also includes two inwardly extending detent projections 168 spaced 180 degrees from one another. Each lock 162 includes a C-shaped skirt 170 connected to a head 172. Skirt 170 of lock 162 defines a lock slot 174 with an open end 176 and a closed end 178. The outer surface 180 of skirt 170 of lock 162 includes a smooth frustoconical surface and two detent recesses 182 spaced 180 degrees from one another.

Each sleeve 160 and lock 162 sits within one of lock cavities 58, 72, 130 when assembled to the ripper tip 18 and/or the shank protector 120. In an unlocked position, frustoconical outer surface 180 of lock skirt 170 sits within frustoconical inner surface 166 of the sleeve 160. Additionally, detent projections 168 of sleeve 160 sit within the detent recesses 182 of the lock 162, so as to resist unintended rotation of lock 162. The unlocked position of lock assembly 62 places open end 176 of lock slot 174 adjacent side slot 60, 74 or 126 of the ripper tip 18 or shank protector 120 (FIGS. 3 and 8). With sleeve 160 and lock 162 in the unlocked position, ripper tip 18 and shank protector 120 can be received on the corresponding projections 42, 38 of ripper shank 16. As the ripper tip 18 and shank protector 120 are received on the ripper shank 16, projections 42, 38 slide through slots 60, 74 and 126 of ripper tip 18 or shank protector 120 and into lock slots 174 of lock 162.

Once the projections 42 and 38 are disposed in lock slots 174 of the lock assemblies 62 of ripper tip 18 and shank protector 120, the locks 162 can be rotated about the projections 42, 38. As lock 162 leaves the unlocked position, recess detents 182 of lock 162 disengage from projection detents 168 of the sleeve 160. As the lock rotates, outer frustoconical surface 180 of the lock 162 slides along the inner frustoconical surface 166 of the sleeve 160. When the lock 162 has rotated 180 degrees, it reaches the locked position, and recess detents 182 of the lock 162 reengage the projection detents 168 of the sleeve 160 to hold the lock 162 in the locked position. In the locked position, closed end 178 of each lock 162 sits behind the associated projection 42, 38 and blocks a side of the lock cavities 58, 72, 130 adjacent slots 60, 74, 126. With projections 42, 38 extending into lock cavities 58, 72, 130, and locks 162 blocking lock cavities 58, 74, 130, projections 42, 38 hold ripper tip 18 and shank protector 120 on the ripper shank 16.

Industrial Applicability

The ripper shank assembly of the present disclosure may be used with any ground-engaging type machine to penetrate tough material and loosen it to aid in removal.

In accordance with the present disclosure, upper projecting ridge 78 of ripper tip 18 provides added material in a location of wear and helps to urge material away from the ripper shank assembly 10. The incorporation of lock assemblies 62 to ripper tip 18 provides for an easy and secure mounting of ripper tip 18 to ripper shank 16. Shank protector 20 also provides for easy and secure mounting to ripper shank 16. In particular, the use of the pivoting-to-lock action to mount the shank protector 20 (FIG. 13) allows the weight of the shank protector 20 to be substantially borne by the ripper shank 16 while moving the shank protector to a locked position. In addition, the thickness distribution of the ridge 138 of shank protector 20—so that a greater thickness is provided near a front end 102 of shank protector 20—serves to prolong the life of shank protector 20 by locating the thicker portion of the ridge 138 where shank protector receives increased wear. Finally, the combination of projecting ridge 78 of ripper tip 18 with ridge 138 of shank protector 20 together serve to urge material away from shank assembly 10 and, in particular, away from the gap provided between ripper tip 18 and shank protector 20. Also, the separate securement of ripper tip 18 to ripper shank 16, and shank protector 20 to ripper shank 26 eases mounting removal.

Other embodiments of the disclosed systems and methods will be apparent to those skilled in the art from consideration of the specification and practice of the systems and methods disclosed herein. It is intended that the specification and examples be considered as exemplary only, with a true scope of the disclosure being indicated by the following claims and their equivalents.

What is claimed is:

1. A ripper tip, comprising:
a front end;
a rear end;
a mounting cavity extending into the rear end; and
an upper surface, the upper surface including
a first ridge including a ridge top, wherein the ridge top includes a substantially planar surface, and
a second ridge disposed between the first ridge and the front end of the ripper tip, the second ridge being flanked by a pair of depressions in the upper surface,
wherein the first ridge includes ridge sides,
the ridge sides include substantially planar surfaces that extend away from the ridge top, and
the ridge sides slope away from one another as they extend away from the ridge top.

2. The ripper tip of claim 1, wherein an end surface of the rear end of the ripper tip has a maximum thickness between the mounting cavity and the ridge top,

3. The ripper tip of claim 1, wherein the upper surface includes a shoulder adjacent a base of each ridge side at the rear end of the ripper tip,

4. The ripper tip of claim 3, wherein the shoulders are substantially coplanar with a top of the second ridge.

5. The ripper tip of claim 1, wherein a side surface of the ripper tip includes a bulge with a lock cavity for receiving a rotating lock to secure the ripper tip to a ripper shank.

6. A ripper tip, comprising:
a front end;
a rear end;
a mounting cavity extending into the rear end; and
an upper surface, the upper surface including
a ridge, the ridge having ridge sides and a ridge top that extend rearward to a rear end surface of the ripper tip,
a shoulder adjacent a base of each ridge side, and
a bulge adjacent a base of each shoulder, wherein:
the ridge top slopes upward as it extends rearward,
the ridge sides slope away from one another as they extend away from the ridge top,
the end surface of the rear end of the ripper tip has a maximum thickness between the mounting cavity and the ridge top,
the end surface defines an opening into the mounting cavity, and
a rear surface of each shoulder includes a convex portion that connects a rear surface of the ridge with a rear surface of one of the bulges.

7. The ripper tip of claim 2, wherein:
the end surface defines an opening into the mounting cavity, and
a rear surface of the ridge is coincident with the end surface.

8. The ripper tip of claim 6, wherein the shoulders include a substantially planar portion.

9. The ripper tip of claim 6, wherein each bulge includes:

a bulge side surface; and an upper surface and a lower surface that slope away from one another as they extend away from the bulge side surface and toward the side surface of the ripper tip.

10. The ripper tip of claim 9, wherein each bulge side surface surrounds a lock opening that extends into a lock cavity for receiving a rotating lock to secure the ripper tip to a ripper shank.

* * * * *